US010836461B1

(12) United States Patent
Smith

(10) Patent No.: US 10,836,461 B1
(45) Date of Patent: Nov. 17, 2020

(54) PORTABLE TRANSDUCER MOUNT

(71) Applicant: Gregory L. Smith, Hoxie, AR (US)

(72) Inventor: Gregory L. Smith, Hoxie, AR (US)

( * ) Notice: Subject to any disclaimer, the term of this patent is extended or adjusted under 35 U.S.C. 154(b) by 0 days.

(21) Appl. No.: 16/679,519

(22) Filed: Nov. 11, 2019

(51) Int. Cl.
*B63B 49/00* (2006.01)
*B63B 17/00* (2006.01)

(52) U.S. Cl.
CPC ..... *B63B 49/00* (2013.01); *B63B 2017/0054* (2013.01)

(58) Field of Classification Search
CPC . B63B 49/00; B63B 2017/0054; B63B 40/00; B63B 201/0054
See application file for complete search history.

(56) References Cited

U.S. PATENT DOCUMENTS 2,646,950 A * 7/1953 Nelson ..... G10K 11/006 248/694
3,752,431 A 8/1973 McBride
3,989,216 A 11/1976 Veatch
4,751,891 A 6/1988 Wilson
5,700,172 A 12/1997 Ousley, II et al.
6,065,420 A 5/2000 Smith

* cited by examiner

*Primary Examiner* — Stephen P Avila
(74) *Attorney, Agent, or Firm* — R. Keith Harrison

(57) ABSTRACT

A portable transducer mount suitable for mounting a transducer on a vessel may include a mount shaft configured for mounting on the vessel. A main shaft may be extendable through the mount shaft. The main shaft may have a shaft leg. A shaft spring may connect the shaft leg to the main shaft. A leaf spring assembly may include at least one elongated, flexible leaf spring carried by the main shaft and the shaft leg of the mount shaft and spanning the shaft spring. A transducer foot assembly may be carried by the shaft leg of the main shaft. The transducer foot assembly may include a base foot plate extending from the shaft leg of the main shaft. A transducer cable conduit may extend between the base foot plate and the shaft leg of the main shaft. A conduit bore may extend through the transducer cable conduit for passage of a transducer cable from the shaft leg through the transducer foot assembly to the transducer.

20 Claims, 8 Drawing Sheets

PORTABLE TRANSDUCER MOUNT

FIELD

Illustrative embodiments of the disclosure generally relate to acoustic marine transducer mount brackets for boats. More particularly, illustrative embodiments of the disclosure relate to a portable transducer mount which is suitable for securing a transducer in a submerged position from the bow of a floating barge or other vessel to monitor water depth and/or water bottom conditions.

BACKGROUND

The background description provided herein is solely for the purpose of generally presenting the context of the illustrative embodiments of the disclosure. Aspects of the background description are neither expressly nor impliedly admitted as prior art against the claimed subject matter.

One of the problems which is inherent in the transportation of cargo by water and particularly, by barge on various waterways is the need to continuously monitor the depth of water and, in some cases, the contour of the water bottom as the barge is pushed or pulled by a tow boat. Valuable time and cargo may be lost under circumstances in which the barge is accidentally grounded on a sandbar, shoal or other shallow area in a river or waterway. Therefore, positioning a depth finding device on a lead barge or vessel in the tow to determine the depth of water and the contour of water bottoms in the waterways is highly desirable.

Conventional transducers and depth finders may include an acoustical transducer mounted beneath the surface of the water and attached by means of a transducer cable to an electronic depth finder or locator device. The device may include a screen across which the topography of the water bottom is typically scrolled and/or the depth of the water indicated. These devices may be useful both in locating fish and in indicating the water depth when used in navigation to avoid grounding of a ship, barge or other vessel.

Conventional mounts or brackets for positioning an acoustic marine hydroplane transducer in the water for the purpose of monitoring the water depth may include an elongated rod or pole having a bracket or mount for securing the rod or pole to the bow of a barge or other vessel. The rod or pole may be fitted with a trip hinge and outrigger spring device near the bottom above a transducer mounted on the extreme end of the rod or pole. The trip hinge and spring mechanism may facilitate rearward extension of a bottom portion or segment of the rod or pole and the transducer under circumstances in which the transducer or the rod or pole strikes a submerged object. The outrigger spring, which may operate in combination with a hinge to achieve this effect, may be cumbersome and difficult to operate and is typically non-adjustable in the hinged mounting of the rod or pole on the end of the barge or other vessel. Transportation and storage of conventional mounts or brackets for transducers may be awkward and difficult due to the complexity of design.

SUMMARY

Illustrative embodiments of the disclosure are generally directed to a portable transducer mount suitable for securing a transducer in a submerged position from the bow of a floating barge or vessel to monitor water depth and/or water bottom conditions. An illustrative embodiment of the portable transducer mount may include a mount shaft typically having a split collar clamp configured for mounting on the vessel. A main shaft may be extendable through the split collar clamp and the mount shaft with a shaft leg. A shaft spring may connect the shaft leg to the main shaft. A transducer foot assembly may be provided on the shaft leg of the main shaft. In some embodiments, the transducer foot assembly may include a base foot plate extending from the shaft leg of the main shaft. A transducer cable conduit may extend between the base foot plate and the shaft leg of the main shaft. A conduit bore may extend through the transducer cable conduit. In some embodiments, a leaf spring assembly may include at least one elongated, flexible leaf spring which is provided on the main shaft and the shaft leg of the main shaft and spans the shaft spring to restrict movement of the shaft leg within a fore-aft plane.

In some embodiments, the portable transducer mount may include a mount shaft having a split collar clamp configured for mounting on the vessel. A main shaft may extend through the split collar clamp and the mount shaft. A shaft spring may connect the main shaft to a shaft leg. A leaf spring assembly including at least one elongated, flexible leaf spring may be carried by the main shaft and the shaft leg in spanning relationship to the shaft spring. A transducer foot assembly may be carried by the shaft leg of the main shaft. The transducer foot assembly may include a base foot plate extending from the shaft leg of the main shaft. A transducer cable conduit may extend between the base foot plate and the shaft leg of the main shaft. A conduit bore may extend through the transducer cable conduit for passage of a transducer cable from the shaft leg to the transducer.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", "diagonal" and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
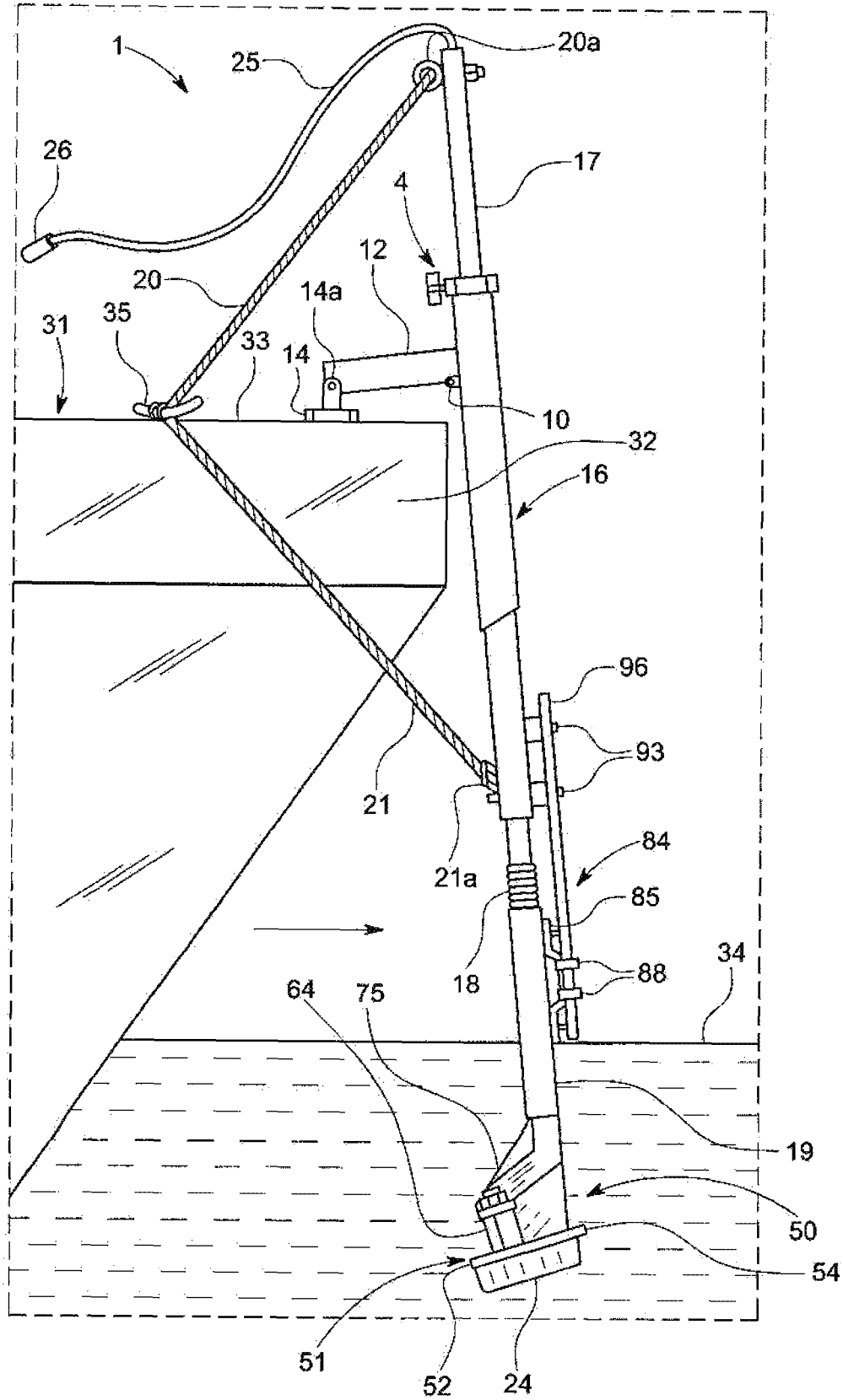
FIG. 1 is a side view of an illustrative embodiment of the portable transducer mount, deployed in a functional configuration on the bow of a vessel floating on a waterbody, with a transducer on the portable transducer mount submerged forwardly of the vessel in a bottom and/or water depth-reading configuration.
Figure 2:
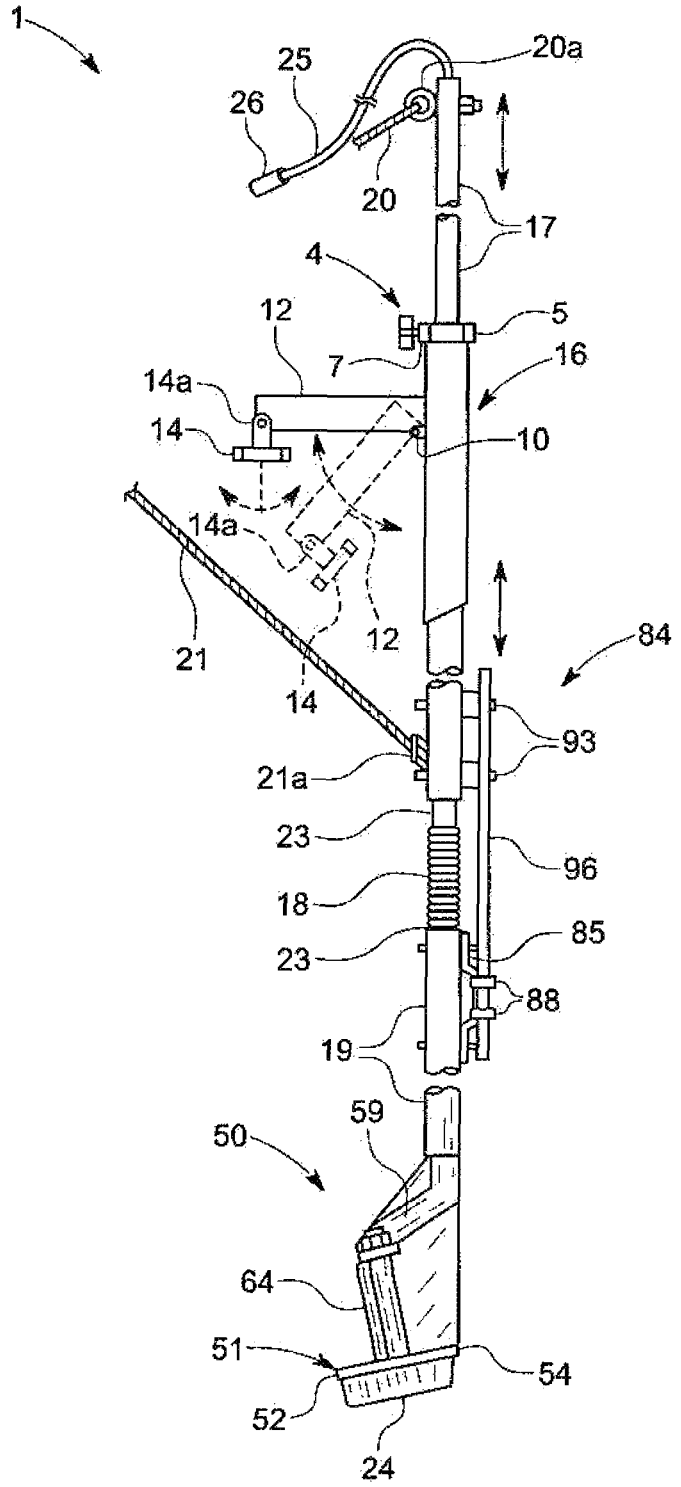
FIG. 2 is an enlarged sectioned side view of an illustrative embodiment of the portable transducer mount as it would appear deployed in the functional configuration on the vessel.

Referring initially to FIGS. 1 and 2 of the drawings, an illustrative embodiment of the portable transducer mount is generally indicated by reference numeral 1. The portable transducer mount 1 may include a mount shaft 16. As illustrated in FIG. 1, the mount shaft 16 may be elongated and cylindrical and configured for mounting on a vessel 31 such as a barge, in some applications. The vessel 31 may have a bow 32 and a deck 33. In typical application of the portable transducer mount 1, the vessel 31 is a barge which is pushed or towed on a water body 34 such as an inland waterway, for example and without limitation, by operation of a tugboat. In other applications, the vessel 31 may be other types of marine vessels.

The mount shaft 16 may be mounted on the vessel 31 using any suitable technique which is known by those skilled in the art and suitable for the purpose. Accordingly, in some applications, at least one collar leg 12 may be mountable to the deck 33 of the vessel 31 such as by using a collar foot 14. The collar leg 12 may be pivotally mounted to the collar foot 14 via a foot pin 14*a* (FIG. 2). The mount shaft 16 may be attached to the collar leg 12 such as via at least one pivot pin bracket 10. In some applications, a pair of collar legs 12 (one of which is illustrated) may attach the mount shaft 16 to each corresponding one of a pair of carrier feet 14 which are attachable to the deck 33 of the vessel 31, such as is described in U.S. Pat. No. 6,065,420, which patent is hereby incorporated by reference herein in its entirety. Alternative methods or techniques known by those skilled in the art and suitable for the purpose may be used to mount the collar legs 12 on the vessel 31.

A split collar clamp 4 may be attached at the upper end of the mount shaft 16. A main shaft 17 may extend through the split collar clamp 4 and the mount shaft 16 with a shaft leg 19. At least one shaft spring 18 may connect the shaft leg 19 to the main shaft 17. In some embodiments, the shaft spring 18 may include a coiled spring. In other embodiments, the shaft spring 18 may include any type of flexible or resilient element or combination of elements which resiliently mounts the shaft leg 19 relative to the main shaft 17. As illustrated in FIG. 2, the shaft spring 18 may be attached to the main shaft 17 and the shaft leg 19 via a pair of respective welds 23, or alternatively, via mechanical fasteners (not illustrated) which are suitable for the purpose.

A transducer foot assembly 50, which will be hereinafter described, may be provided on the shaft leg 19 of the main shaft 17. At least one transducer 24 may be mounted on the transducer foot assembly 50. The transducer foot assembly 50 may maintain the transducer 24 beneath the surface of the water body 34 during travel of the vessel 31 on the water body 34.

The main shaft 17 may be mounted for selective longitudinal adjustment with respect to the mount shaft 16 using any suitable technique known by those skilled in the art. Accordingly, in some embodiments, a split collar clamp 4 may be fitted to the top end of the mount shaft 16. The split collar clamp 4 may have a design which is the same as or similar to that of the split collar clamp 4 described in U.S. Pat. No. 6,065,420. The split collar clamp 4 may facilitate selective sliding and fixed positioning of the main shaft 17 at a selected vertical or angular position in the mount shaft 16.

In typical mounting of the portable transducer mount 1 on the vessel 31, at least one top cable 20 may attach the upper end of the main shaft 17 to a cleat 35 or other suitable structural attachment element on the deck 33 of the vessel 31. The top cable 20 may be attached to the main shaft 17 by an eye bolt 20*a*. At least one bottom cable 21 may attach the lower end portion of the main shaft 17, as illustrated, or alternatively, the shaft leg 19 of the main shaft 17 to the cleat 35. The bottom cable 21 may be attached to the main shaft 17 or the shaft leg 19 by an eye bolt 21*a*. The top cable 20 and the bottom cable 21 may ensure that the portable transducer mount 1 is stabilized in the position illustrated in FIG. 1 as the vessel 31 traverses the water body 34 and the transducer foot assembly 50 and transducer 24 are maintained beneath the surface of the water body 34.

Figure 3:
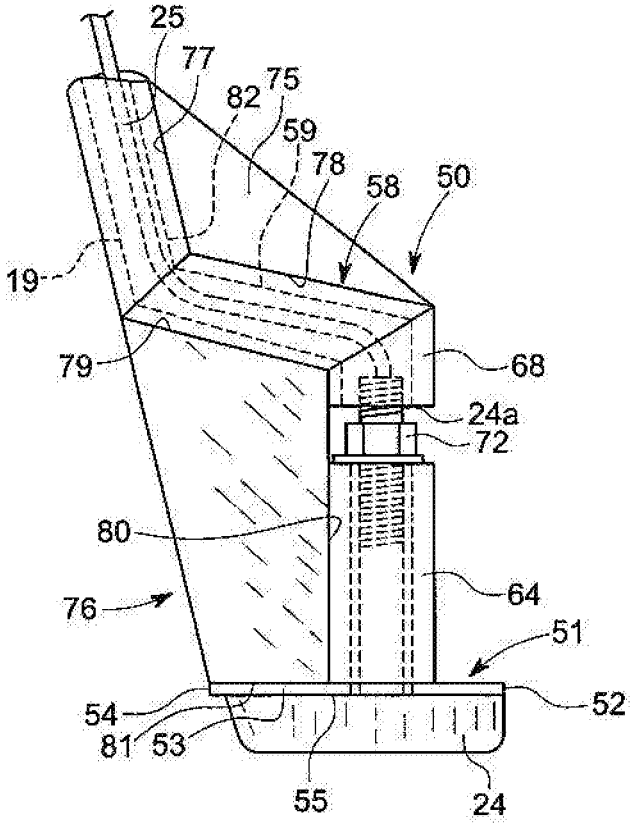
FIG. 3 is a side view of a typical transducer foot assembly of an illustrative embodiment of the portable transducer mount.
Figure 4:
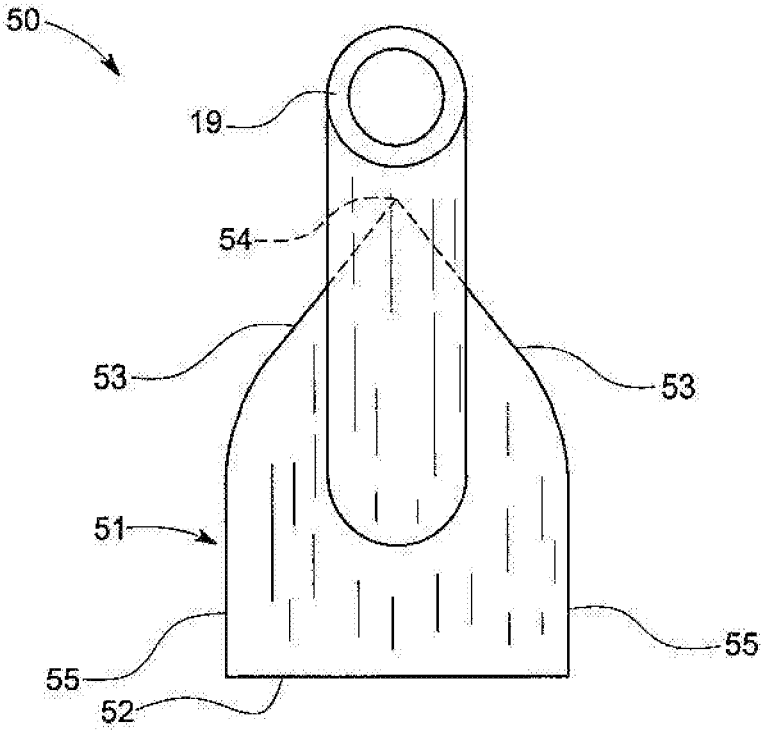
FIG. 4 is a top view of the transducer foot assembly illustrated in FIG. 3.
Figure 5:
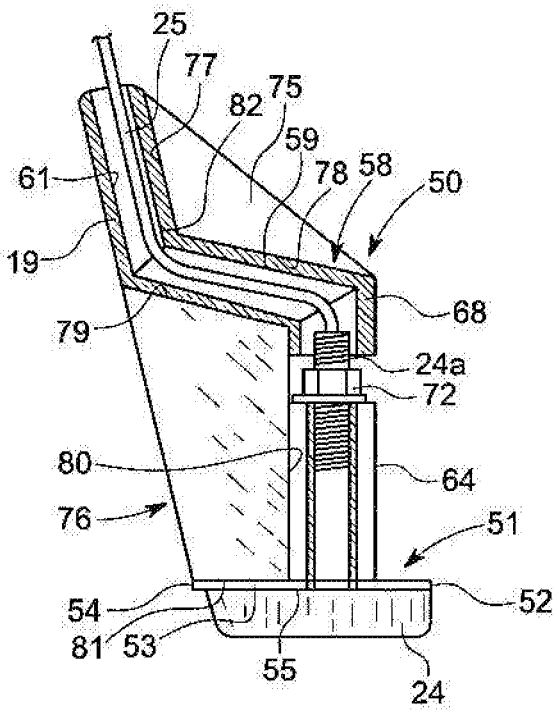
FIG. 5 is a vertical sectional view of the transducer foot assembly.
Figure 6:
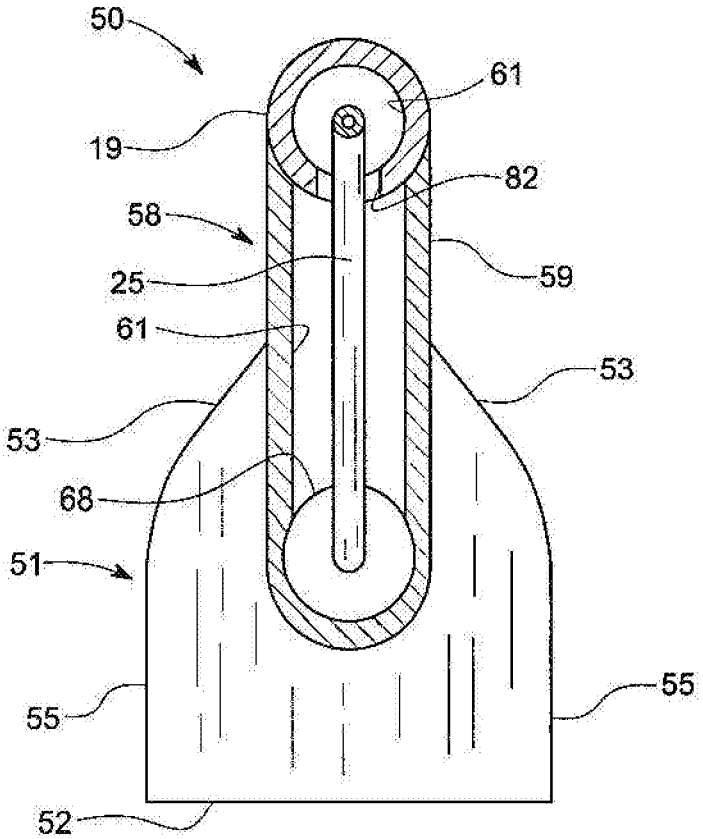
FIG. 6 is a horizontal sectional view of the transducer foot assembly.
Figure 7:
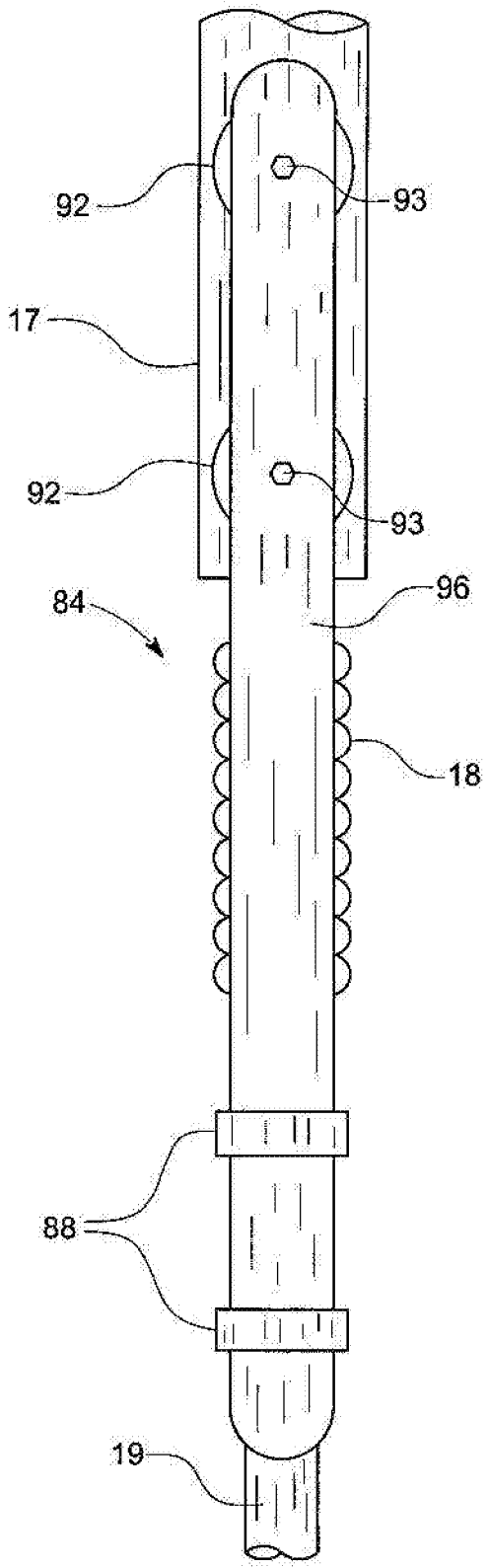
FIG. 7 is a front view of a typical leaf spring assembly mounted on the main shaft (in section) and the shaft leg (in section) of an illustrative embodiment of the portable transducer mount.

Referring next to FIGS. 3-6 of the drawings, the transducer foot assembly 50 of the portable transducer mount 1 may include a base foot plate 51 which extends from the shaft leg 19 of the main shaft 17. A transducer cable conduit 58 may extend between the base foot plate 51 and the shaft leg 19 of the main shaft 17. As illustrated in FIGS. 5 and 6, a conduit bore 61 may extend through the transducer cable conduit 38. As illustrated in FIG. 5, a transducer 24 may be mounted on the bottom surface of the base foot plate 51. The conduit bore 61 may facilitate passage of a transducer cable 25 from the main shaft 17 to the transducer 24 mounted on the base foot plate 51. A cable opening 82 may be provided in the shaft leg 19 in alignment or registration with the conduit bore 61 to facilitate passage of the transducer cable 25 from the shaft leg 19 into the conduit bore 61.

As illustrated in FIG. 4, the base foot plate 51 may be generally elongated with a straight trailing plate edge 52. A pair of straight side plate edges 55 may extend from the trailing plate edge 52. A pair of converging leading plate edges 53 may extend from the respective side plate edges 55. A tapered or pointed leading plate apex 54 may terminate the converging leading plate edges 53.

As illustrated in FIGS. 3 and 5, in some embodiments, the transducer cable conduit 58 may include a lower vertical conduit segment 64 which extends from the base foot plate 51. A diagonal conduit segment 59 may extend from the shaft leg 19 of the main shaft 17. An upper vertical conduit segment 68 may extend from the diagonal conduit segment 59. The upper vertical conduit segment 68 may terminate in spaced-apart relationship with respect to the lower vertical conduit segment 64. As illustrated in FIG. 5, the conduit bore 61 through which the transducer cable 25 extends may traverse the diagonal conduit segment 59, the upper vertical conduit segment 68 and the lower vertical conduit segment 64. A cable opening 82 may terminate the shaft leg 19 of the main shaft 17 typically in diagonal orientation to the longitudinal axis of the diagonal conduit segment 59.

A threaded shaft segment 24*a* of transducer 24 may extend through the lower vertical conduit segment 64 of the transducer cable conduit 58. A retaining nut 72 may threadably engage the threaded shaft segment 24*a* of the transducer 24. As further illustrated in FIG. 5, the threaded shaft segment 24*a* of transducer 24 and the transducer cable 25 may extend through the upper vertical conduit segment 68 of transducer cable conduit 58. The upper vertical conduit segment 68 may connect to the diagonal conduit segment 59 of the transducer cable conduit 58. Accordingly, as it passes through the diagonal conduit segment 59 and the cable opening 82, the transducer cable 25 may extend through the cable opening 82 in the shaft leg 19 of the main shaft 17.

As illustrated in FIG. 3, in some embodiments, the transducer foot assembly 50 may further include at least one upper reinforcing foot plate 75. The upper reinforcing foot plate 75 may have a leading plate edge 77 which may be welded and/or otherwise attached rearwardly to the shaft leg 19 of the main shaft 17 and a lower plate edge 78 which may be welded and/or otherwise attached upwardly to the diagonal conduit segment 59 of the transducer cable conduit 58 for reinforcing purposes.

The transducer foot assembly 50 may further include at least one lower reinforcing plate 76 for reinforcing purposes. The lower reinforcing plate 76 may have an upper facing edge 79 which may be welded and/or otherwise attached to the lower edge of the diagonal conduit segment 59 of the transducer cable conduit 58, a rearward edge 80 which may be welded and/or otherwise attached to the leading edges of the upper vertical conduit segment 68 and the vertical conduit segment 64 respectively, and a bottom plate edge 81 which may be welded and/or otherwise attached to the upper surface of the base foot plate 51, terminating at the pointed leading plate apex 54 of the base foot plate 51.

Referring next to FIGS. 7-10 of the drawings, in some embodiments, the portable transducer mount 1 may include a leaf spring assembly 84. The leaf spring assembly 84 may include at least one elongated, flexible leaf spring 96. The leaf spring 96 may be fabricated of hardened steel or other flexible or bendable metal or material. The leaf spring 96 may be attached to the main shaft 17 and to the shaft leg 19 of the main shaft 17 and spans the shaft spring 18. Accordingly, as particularly illustrated in FIGS. 8-10, in some embodiments, at least one leaf spring mount boss 92 may extend from the main shaft 17. At least one boss fastener 93 may fixedly attach the leaf spring 96 to the leaf spring mount boss 92. A leaf spring mount bracket 85 may be attached to the shaft leg 19 such as by at least one bracket fastener 86. At least one bracket mount sleeve 88 may be provided on the leaf spring mount bracket 85. The leaf spring 96 may extend through the bracket mount sleeves 88 to facilitate sliding longitudinal movement of the leaf spring 96 with respect to the leaf spring mount bracket 85 and the shaft leg 19 of the main shaft 17. Alternative techniques may be used to fixedly mount the leaf spring 96 with respect to the main shaft 17 and slidably mount the leaf spring 96 with respect to the shaft leg 19 of the main shaft 17. In some embodiments, the leaf spring 96 may be fixedly attached to the shaft leg 19 and slidably mounted with respect to the main shaft 17.

Figure 8:
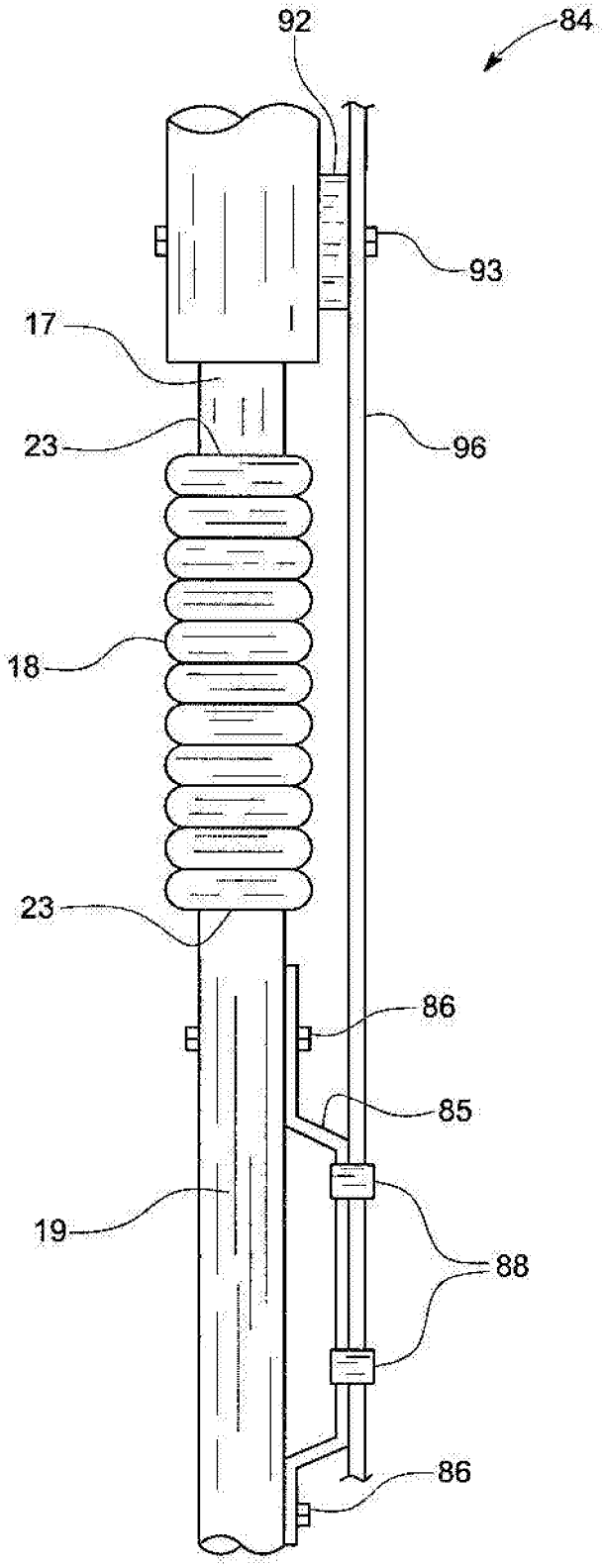
FIG. 8 is a side view of the leaf spring assembly disposed in a straight or non-flexed configuration.
Figure 9:
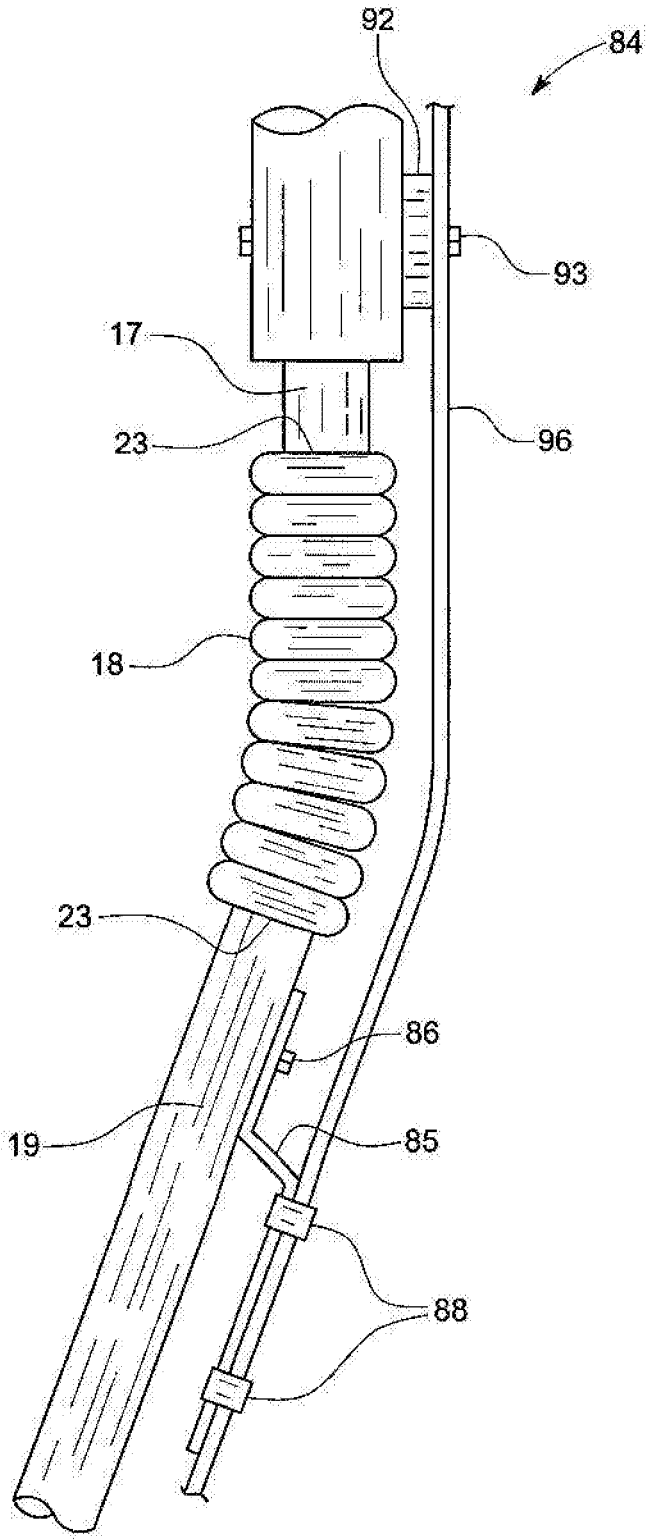
FIG. 9 is a side view of the leaf spring assembly disposed in a rearwardly-flexed configuration.
Figure 10:
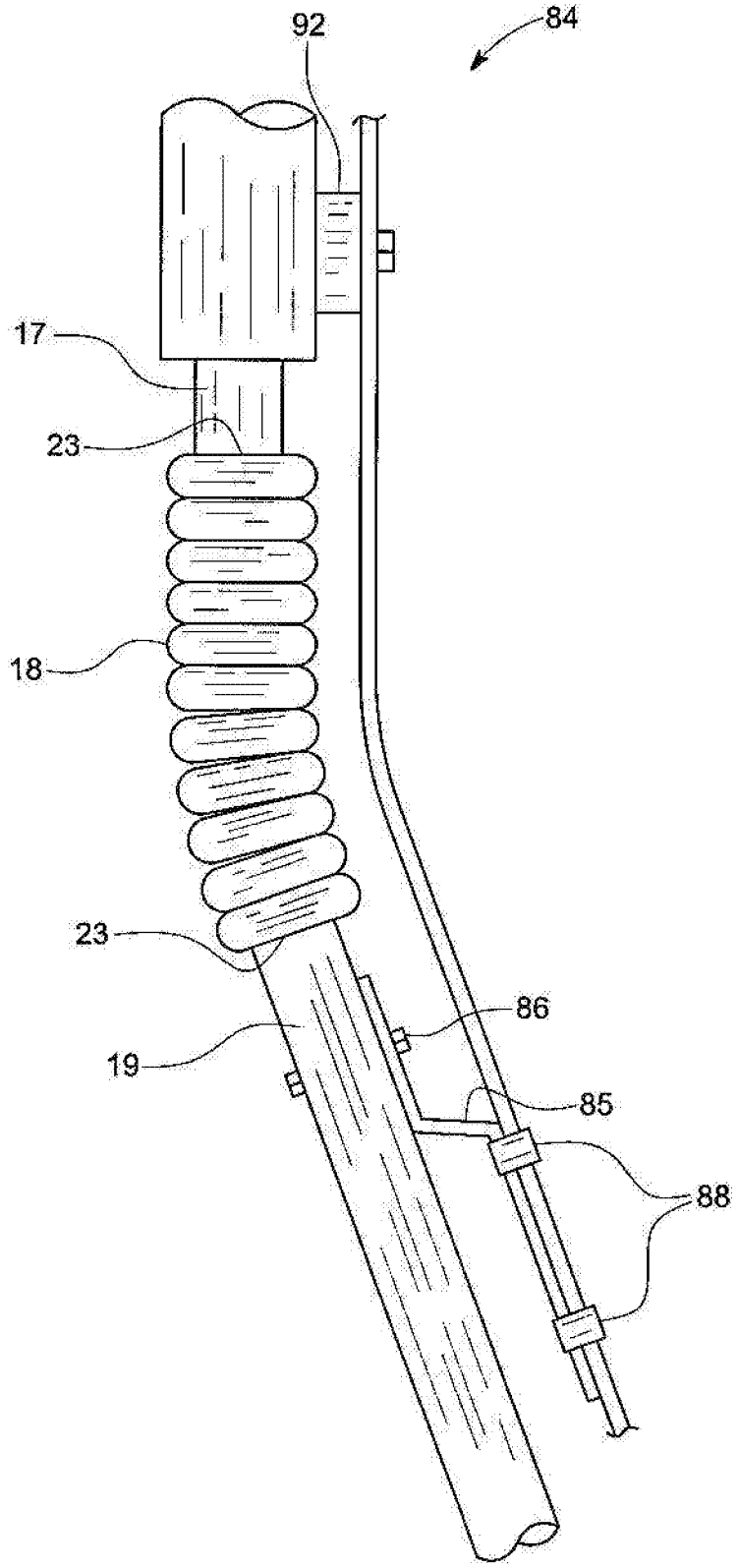
FIG. 10 is a side view of the leaf spring assembly disposed in a forwardly-flexed configuration.

As illustrated in FIG. 8, throughout operation of the portable transducer mount 1, the shaft spring 18 may normally maintain the main shaft 17 in a substantially vertical or angular orientation with the shaft leg 19 disposed in linear alignment with the main shaft 17. The leaf spring 96 may permit rearward movement (FIG. 9) or forward movement (FIG. 10) of the shaft leg 19 with respect to the main shaft 17 while preventing side-to-side movement of the shaft leg 19 with respect to the main shaft 17. Accordingly, the leaf spring 96 may enable the main shaft 17 to flex in the event that the shaft leg 19, transducer foot assembly 50 or transducer 25 strikes a submerged obstacle or encounters swift current and prevents side-to-side movement which may otherwise cause the transducer 25 to lose the transducer signal.

Referring again to FIGS. 1 and 2 of the drawings, in typical application, the portable transducer mount 1 may be removably mounted in the functional position illustrated in FIG. 1 such that the transducer 24 is submerged with the transducer foot assembly 50 beneath the surface of the water body 34. In some embodiments, each collar foot 14 may be fitted with a magnet (not illustrated) for magnetic attachment to the iron or steel deck 33 on the vessel 31. Accordingly, the collar feet 14 on the respective collar legs 12 may be attached to the deck 33 at the bow 32 of the vessel 31. The top cable 20 may be attached to the eye bolt 20*a* at the top end of the main shaft 17 and to the cleat 35 on the deck 33 of the vessel 31. The bottom cable 21 may be attached to the eye bolt 21*a* on the shaft leg 19 of the main shaft 17 and to the cleat 35.

The position of the main shaft 17 in the mount shaft 16 may be adjusted as deemed necessary by means of the split collar clamp 4 to position the transducer foot assembly 50 and transducer 24 at a selected depth beneath the surface of the water body 34. Accordingly, the split collar clamp 4 may be loosened to facilitate sliding of the mount shaft 16 in the mount collar 2 until the transducer foot assembly 50 reaches the desired position.

As illustrated in FIGS. 1 and 2, a cable plug 26 may terminate the free end of the transducer cable 25. The cable plug 26 may be attached to a suitable conventional depth finder device (not illustrated) which is known by those skilled in the art to permit a continuous digital readout of the depth of the water body 34 and optionally, the topography of the water bottom, as the vessel 31 moves through the water body 34 in the direction of the arrow illustrated in FIG. 1.

As illustrated in FIGS. 3 and 5, the transducer 24 may be mounted on the lower surface of the base foot plate 51 of the transducer foot assembly 50 using a transducer mount bracket, mechanical fasteners and/or other suitable transducer mounting techniques (not illustrated) known by those skilled in the art. For example and without limitation, in some embodiments, the transducer 24 may be mounted to the base foot plate 51 in the manner which is described in U.S. Pat. No. 6,065,420. The end of the transducer cable 25 which is opposite the cable plug 26 may be extended through the main shaft 17 and the shaft leg 19. As illustrated in FIG. 5, the transducer cable 25 may be extended from the shaft leg 19 through the cable opening 82 and through the conduit bore 61 of the diagonal conduit segment 59, the upper vertical conduit segment 68 and the lower vertical conduit segment 64 of the transducer cable conduit 58 on the transducer foot assembly 50. The transducer cable 25 may extend from the conduit bore 61 of the vertical conduit segment 64 through a cable opening (not illustrated) in the base foot plate 51 and connect to the transducer 24.

Referring again to FIGS. 1, 9 and 10 of the drawings, under circumstances in which the transducer 24, the transducer foot assembly 50 or the shaft leg 19 of the main shaft 17 strikes a submerged object or obstacle in the water body 34, the shaft spring 18 provides sufficient resiliency and tension in the connection between the main shaft 17 and the shaft leg 19 to allow the main shaft 17 to deflect from the longitudinal centerline of the main shaft 17 and prevent damage to the main shaft 17, the transducer foot assembly 50 and/or the transducer 24. The leaf spring 96 of the leaf spring assembly 84 may permit rearward (FIG. 9) and forward (FIG. 10) flexion or movement of the shaft leg 19 with respect to the main shaft 17 while preventing side-to-side flexion of the shaft leg 19 which may otherwise cause transducer signal loss. The leaf spring 96 may further protect and prevent damage to the shaft spring 18 in the event that the portable transducer mount 1 strikes an object in the water body 34. As the vessel 31 travels on the water body 34, the typically tapered or pointed configuration of the base foot plate 51 of the transducer foot assembly 50, as was heretofore described with respect to FIG. 4, may facilitate substantially unhindered travel of the transducer foot assembly 1 in the water body 34.

It will be appreciated by those skilled in the art that the base foot plate 51 of the transducer foot assembly 50 may be mounted at an obtuse angle with respect to the longitudinal axis of the main shaft 17, as was heretofore described with respect to FIGS. 3 and 5 to allow for the initial flex of the shaft spring 18. This, in turn, allows the entire main shaft 17 to be mounted either straight up and down or at a slightly rearward angle without a corresponding loss of transducer signal under circumstances in which the vessel 31 travels in swift current or at higher speeds in the water body 34. Moreover, due to the rearward position of the base foot plate 51, the drift catching point on the front of the shaft leg 19 is eliminated, allowing drift to slide down and off the smooth surface on the front of the shaft leg 19 without the drift otherwise hanging up on the front of the shaft leg 19 and causing the shaft leg 19 to flex far enough backward to cause cavitation under the transducer 24 and signal loss. By using an open throat design on the back of the transducer foot assembly 50 on the shaft leg 19, a conventional nut may be used to fasten the transducer 24 to the shaft leg 19 using a standard wrench. This expedient allows more torque to be applied to secure the transducer 24 and facilitates replacement of the transducer 24 as needed.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A portable transducer mount suitable for mounting a transducer on a vessel, comprising:

a mount shaft configured for mounting on the vessel;

a main shaft extendable through the mount shaft, the main shaft having a shaft leg;

a shaft spring connecting the shaft leg to the main shaft; and a transducer foot assembly carried by the shaft leg of the main shaft, the transducer foot assembly including:

a base foot plate extending from the shaft leg of the main shaft, the base foot plate oriented at an obtuse angle relative to a longitudinal axis of the shaft leg of the main shaft allow for initial flex of the shaft spring;

a transducer cable conduit extending between the base foot plate and the shaft leg of the main shaft; and a conduit bore extending through the transducer cable conduit.

2. A portable transducer mount suitable for mounting a transducer on a vessel, comprising:

a mount shaft configured for mounting on the vessel;

a main shaft extendable through the mount shaft, the main shaft having a shaft leg;

a shaft spring connecting the shaft leg to the main shaft; and a transducer foot assembly carried by the shaft leg of the main shaft, the transducer foot assembly including:

a base foot late extending from the shaft leg of the main shaft;

a transducer cable conduit extending between the base foot plate and the shaft leg of the main shaft; and a conduit bore extending through the transducer cable conduit; and wherein the transducer cable conduit comprises:

a lower vertical conduit segment extending from the base foot plate;

an upper vertical conduit segment disposed above and in vertical alignment with the lower vertical conduit segment; and a diagonal conduit segment extending from the upper vertical conduit segment to the shaft leg of the main shaft; and wherein the conduit bore extends through the lower vertical conduit segment, the upper vertical conduit segment and the diagonal conduit segment.

3. The portable transducer mount of claim 2 further comprising a transducer carried by the base foot plate of the transducer foot assembly, the transducer having a threaded shaft segment extending through the base foot plate and the lower vertical conduit segment and a retaining nut threadably engaging the threaded shaft segment of the transducer.

4. The portable transducer mount of claim 2 further comprising a cable opening in the shaft leg of the main shaft in communication with the conduit bore.

5. The portable transducer mount of claim 1 further comprising at least one collar leg extending from the mount shaft, the at least one collar leg configured for attachment to the vessel.

6. The portable transducer of claim 2 wherein the base foot plate is oriented at an obtuse angle relative to the shaft leg of the main shaft.

7. The portable transducer mount of claim 6 wherein the obtuse angle is 98-102 degrees.

8. A portable transducer mount suitable for mounting a transducer on a vessel, comprising:

a mount shaft configured for mounting on the vessel;

a main shaft extendable through the mount shaft, the main shaft having a shaft leg;

a shaft spring connecting the shaft leg to the main shaft; and a transducer foot assembly carried by the shaft leg of the main shaft, the transducer foot assembly including:

a base foot plate extending from the shaft leg of the main shaft;

a transducer cable conduit extending between the base foot plate and the shaft leg of the main shaft;

a conduit bore extending through the transducer cable conduit; and wherein the base foot plate comprises a straight trailing plate edge; a pair of straight side plate edges extending from the straight trailing plate edge; a pair of converging leading plate edges extending from the pair of side plate edges, respectively; and a tapered or pointed leading plate apex terminating the leading plate edges.

9. A portable transducer mount suitable for mounting a transducer on a vessel, comprising:

a mount shaft configured for mounting on the vessel;

a main shaft extendable through the mount collar, the main shaft having a shaft leg;

a shaft spring connecting the shaft leg to the main shaft;

a transducer foot assembly carried by the shaft leg of the main shaft; and a leaf spring assembly including at least one elongated, flexible leaf spring carried by the main shaft and the shaft leg of the main shaft and spanning the shaft spring.

10. The portable transducer mount of claim 9 wherein the leaf spring assembly comprises a leaf spring mount bracket carried by the shaft leg of the main shaft and wherein the at least one leaf spring is carried by the leaf spring mount bracket.

11. The portable transducer mount of claim 10 wherein the at least one leaf spring is slidably carried by the leaf spring mount bracket.

12. The portable transducer mount of claim 11 further comprising at least one bracket mount sleeve carried by the leaf spring mount bracket, and wherein the leaf spring extends through the at least one bracket mount sleeve.

13. The portable transducer mount of claim 9 further comprising at least one leaf spring mount boss carried by the main shaft, and wherein the leaf spring is carried by the leaf spring mount boss.

14. A portable transducer mount suitable for mounting a transducer on a vessel, comprising:

a mount shaft configured for mounting on the vessel;

a main shaft extendable through the mount shaft, the main shaft having a shaft leg;

a shaft spring connecting the shaft leg to the main shaft;

a leaf spring assembly including at least one elongated, flexible leaf spring carried by the main shaft and the shaft leg of the main shaft and spanning the shaft spring; and a transducer foot assembly carried by the shaft leg of the main shaft, the transducer foot assembly including:

a base foot plate extending from the shaft leg of the main shaft;

a transducer cable conduit extending between the base foot plate and the shaft leg of the mount shaft;

a conduit bore extending through the transducer cable conduit; and at least one reinforcing plate reinforcing the transducer cable conduit in the transducer foot assembly.

15. The portable transducer mount of claim 14 wherein the transducer cable conduit comprises:

a lower vertical conduit segment extending from the base foot plate;

an upper vertical conduit segment disposed above and in vertical alignment with the lower vertical conduit segment; and a diagonal conduit segment extending from the upper vertical conduit segment to the shaft leg of the main shaft; and wherein the conduit bore extends through the lower vertical conduit segment, the upper vertical conduit segment and the diagonal conduit segment.

16. The portable transducer mount of claim 15 further comprising a transducer carried by the base foot plate of the transducer foot assembly, the transducer having a threaded shaft segment extending through the base foot plate and the lower vertical conduit segment and a retaining nut threadably engaging the threaded shaft segment of the transducer.

17. The portable transducer mount of claim 15 further comprising a cable opening in the shaft leg of the main shaft in communication with the conduit bore.

18. The portable transducer mount of claim 14 wherein the base foot plate is oriented at an obtuse angle relative to the shaft leg of the main shaft.

19. The portable transducer of claim 18 wherein the angle is 98-102 degrees.

20. The portable transducer mount of claim 14 wherein the base foot plate comprises a straight trailing plate edge; a pair of straight side plate edges extending from the straight trailing plate edge; a pair of converging leading plate edges extending from the pair of side plate edges, respectively; and a tapered or pointed leading plate apex terminating the leading plate edges.

* * * * *